US006715159B2

(12) United States Patent
Cormier

(10) Patent No.: US 6,715,159 B2
(45) Date of Patent: Apr. 6, 2004

(54) ANGULARLY DISENGAGEABLE GLOVE-TO-CUFF CONNECTION APPARATUS

(75) Inventor: Richard Cormier, Val-d'Or (CA)

(73) Assignee: Her Majesty the Queen in right of Canada as represented by the Minister of Natural Resources, Ontario (CA)

( * ) Notice: Subject to any disclaimer, the term of this patent is extended or adjusted under 35 U.S.C. 154(b) by 57 days.

(21) Appl. No.: 10/162,204

(22) Filed: Jun. 5, 2002

(65) Prior Publication Data

US 2002/0189007 A1 Dec. 19, 2002

Related U.S. Application Data

(63) Continuation-in-part of application No. 09/865,426, filed on May 29, 2001, now abandoned.

(51) Int. Cl.[7] ..... A41D 13/00; A41D 19/00

(52) U.S. Cl. ..... 2/457; 2/161.4; 2/161.6; 2/270; 2/910

(58) Field of Search ..... 2/457, 2.17, 160, 2/60, 161.4, 161.6, 162, 270, 2.12, 2.15, 2.14, 910, 170, 456

(56) References Cited

U.S. PATENT DOCUMENTS

| | | | | | |
|---|---|---|---|---|---|
| 2,410,632 | A | * | 11/1946 | Colley et al. | 2/2.14 |
| 2,596,112 | A | * | 5/1952 | Aines | 2/232 |
| 2,655,663 | A | | 10/1953 | Hoagland | |
| 2,813,272 | A | * | 11/1957 | Hagan | 2/16 |
| 3,000,014 | A | * | 9/1961 | White | 2/270 |
| 3,009,164 | A | | 11/1961 | Frey | |
| 3,099,015 | A | | 7/1963 | Renehan | |
| 3,103,016 | A | | 9/1963 | Perlman | |
| 3,743,368 | A | * | 7/1973 | Elkins et al. | 277/562 |
| 3,747,126 | A | * | 7/1973 | Hoagland | 2/270 |
| 4,131,952 | A | * | 1/1979 | Brenning, Jr. | 2/124 |
| 4,141,609 | A | * | 2/1979 | Eisert | 312/1 |
| 4,471,495 | A | * | 9/1984 | Kruse et al. | 2/162 |
| 4,479,268 | A | | 10/1984 | Tillbrook | |
| 4,530,350 | A | * | 7/1985 | Brown et al. | 602/3 |
| 4,800,595 | A | | 1/1989 | Askew | |
| 4,984,828 | A | * | 1/1991 | Lepissier | 285/200 |
| 5,555,561 | A | * | 9/1996 | Plachta et al. | 2/270 |
| 6,006,355 | A | * | 12/1999 | Abts | 2/2.11 |
| 6,081,925 | A | * | 7/2000 | Reiber | 2/125 |
| 6,523,181 | B2 | * | 2/2003 | Medves | 2/161.6 |

FOREIGN PATENT DOCUMENTS

| | | | | |
|---|---|---|---|---|
| DE | 19701343 | * | 7/1998 | |
| EP | 57517 A2 | * | 8/1982 | A62B/17/00 |
| EP | 406139 | * | 1/1991 | |
| FR | 2687076 | * | 8/1993 | |
| GB | 2243103 | | 10/1991 | |
| WO | WO98/24599 | | 6/1998 | |
| WO | 9854990 | * | 12/1998 | |

* cited by examiner

*Primary Examiner*—Rodney M. Lindsey
(74) *Attorney, Agent, or Firm*—Jones, Tullar & Cooper PC

(57) ABSTRACT

An apparatus for releasably sealing the opening between a glove and the sleeve cuff to prevent ingress of water therebetween. The apparatus includes a pair of rings, one of which is attached to the wrist portion of a glove while the other is attached to the cuff portion of a sleeve. The rings are releasably engageable with one another in the sealed fashion under normal working conditions. The rings are capable of self-disengaging angularly and/or axially when subjected to an angular force or moment of predetermined magnitude and duration applied to the connection so as to permit detachment of the glove. The apparatus is particularly useful in wet mining applications not only to prevent water from entering the opening between the glove and cuff but also to disengage safely and assuredly should a glove get caught in any equipment.

44 Claims, 12 Drawing Sheets

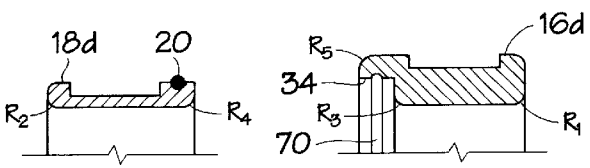
Fig. 8A
Fig. 8B
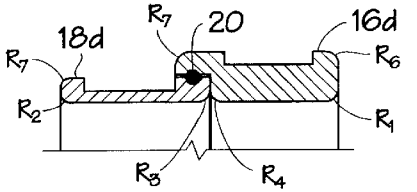
Fig. 9
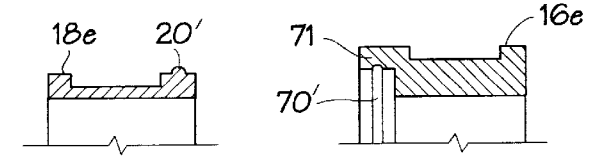
Fig. 10A
Fig. 10B
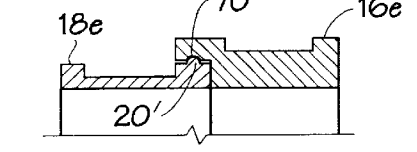
Fig. 11
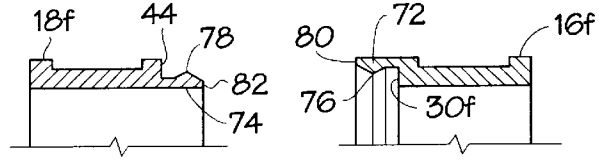
Fig. 12A
Fig. 12B
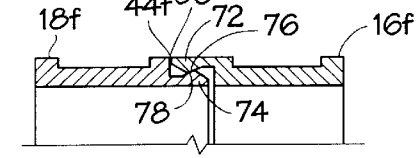
Fig. 13
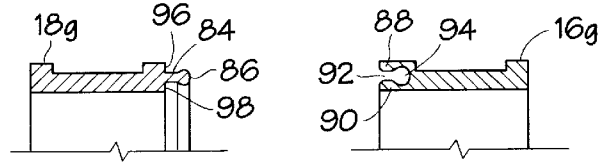
Fig. 14A
Fig. 14B
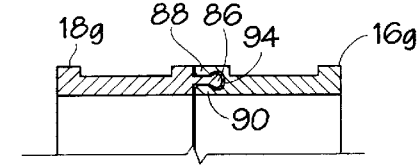
Fig. 15

ANGULARLY DISENGAGEABLE GLOVE-TO-CUFF CONNECTION APPARATUS

CROSS REFERENCE TO RELATED APPLICATIONS

This application is a continuation-in-part of U.S. application Ser. No. 09/865,426, which was filed on May 29, 2001 now abandoned.

BACKGROUND OF THE INVENTION

The present invention relates to glove-to-cuff seals and, in particular, to an apparatus for releasably connecting the wrist portion of a glove to a sleeve cuff to prevent ingress of water. The apparatus is designed to readily connect a glove to a sleeve and readily disconnect for removal and/or safety purposes. The connection apparatus has a short connection length which permits immediate release, even under angularly applied forces. In wet environments, such as those found in the mining industry, workers or miners often require safety gloves and apparel which are waterproof. In underground mines, water which is present naturally or introduced in the mining process tends to infiltrate the miner's gloves through the separation between the glove and the sleeve of the jacket. Continuous exposure to these wet conditions is known to cause diseases of the hands.

Accordingly, there is a need for a sealing arrangement at or near the glove/cuff interface which will prevent ingress of water. However, for safety reasons, since much of the machinery used in mines has moving parts in which clothing items such as gloves can be caught and pulled off the wearer, having a readily releasable glove is seen as a safety necessity. Accordingly, any connection between the cuff and the glove must be not only waterproof but also readily detachable to prevent serious injury should a glove get caught in machinery. For safety reasons, the disengagement under an applied force should occur automatically and without the need for the wearer to perform any specific operation or manipulation.

It is known to utilize a strap or similar constrictive element to compress an overlapped cuff and glove wrist portion at the wearer's wrist. It is also known to use a cylindrical intermediary to which both the cuff and sleeve are attached. The problem with such systems is that the releasability of the connection, even if it can occur without the requirement for manual manipulation or additional operations, does not occur in a safe, assured and controlled manner.

Known prior art sleeve-to-cuff connection systems are primarily concerned with providing a positive connection yet are not overly concerned about disconnectability. Disconnectability is a serious safety issue, particularly with workers utilizing machinery, where a glove is too often snagged on moving parts.

It would therefore be desirable to be able to ensure the glove will separate from the cuff automatically in response to a force of predetermined magnitude and duration. In this regard, it would be advantageous to be able to design or engineer this force threshold into the connection rather than permit a user to make a connection whose releasability is dependent on the manner by which the user effects the connection, such as can be the case for example with systems which employ user tightenable straps. Since the force applied to the connection when the glove is caught in machinery is not always axial with respect to the connection, it is also desirable to ensure disconnection can occur angularly.

SUMMARY OF THE INVENTION

The present invention provides a simple, inexpensive and easy to implement apparatus for releasably sealing the wrist portion of a glove to a cuff to prevent ingress of water. In general, a first ring is sealingly attached or retained by the cuff while the wrist portion of the glove is sealingly attached to a second ring. The rings are sealingly connectable to one another and separable upon application of a force of predetermined magnitude, direction and duration.

By providing a separable connection apparatus having two components, each of which being temporarily but securely attachable to one of the cuff or the glove, one is better able to control through the manufacturing and material selection process and actually design or engineer quite precisely the resultant disengagement force threshold.

In general, the invention provides an apparatus for releasably securing a glove to a cuff comprising a first ring sealingly attachable to a cuff and second ring sealingly attachable to a glove. The first and second rings are releasably and sealingly connectable to one another to prevent ingress of water therebetween, and the rings are angularly disengageable from one another upon application of an angular separating force of predetermined magnitude and duration.

In accordance with another aspect of the invention, there is provided an apparatus for releasably securing a glove to a cuff comprising:

- a first ring sealingly attachable to a cuff and second ring sealingly attachable to a wrist portion of a glove,
- one of the rings having an insertable portion which is insertable within a receiving portion of the other ring, there being a circumferential space between at least a part of said insertable portion and the receiving portion,
- connecting means for releasably and sealingly connecting the rings together when the insertable portion is inserted within the receiving portion to prevent ingress of water between the rings,
- the rings including stop means for limiting the extent to which the insertable portion is insertable within the receiving portion so as to permit angular disengagement of the rings under application of a predetermined angular force or moment on said rings.

In another embodiment, the apparatus for releasably securing a glove to a cuff comprises:

- a first ring having an external circumferential channel against which a cuff can be held by a first constriction means;
- a second ring having an external circumferential channel against which a wrist portion of a glove can be held by a second constriction means, the second ring being coaxially insertable at least in part within the first ring so as to form an overlap between the rings;
- sealing and retention means provided on an external circumferential surface of the first ring compressible against an internal circumferential surface of the second ring for releasably retaining the second ring in sealing engagement with the first ring, the internal circumferential surface of the second ring being spaced apart from the external circumferential surface of the first ring; and
- stop means for limiting the extent of insertion of the second ring whereby the amount overlap of the first ring with respect to the second ring in conjunction with the spacing between the internal circumferential surface of the second ring and the external circumferential surface of the first ring is sufficient so as to permit angular disconnection of the rings upon application of an angular separating force or moment of predetermined magnitude and duration.

Preferably, in this embodiment, the sealing and retaining means takes the form of an o-ring. For safety reasons, the longitudinal extent to which the o-ring is engageable with the internal surface is minimal to reduce the duration a disengaging force would have to be applied before disengagement of said rings would occur. Because this embodiment relies on friction for retention purposes, a force sufficient to overcome the friction is all that is required for disengagement, i.e. disengagement occurs without any additional steps or operations.

The invention also provides for alternate structures for releasably connecting the rings in a sealed relationship.

The apparatus is simple, inexpensive, easy to implement, and should fit existing apparel/gloves.

Recent developments in mining technology have resulted in increased usage of water in certain mining operations. The present invention should encourage miners to adopt wetter working conditions. These and other features and advantages will become apparent from the following description and as illustrated in the accompanying drawings.

BRIEF DESCRIPTION OF THE DRAWINGS

FIGS. 8A and 8B are cross-sectional profiles of a further pair of modified connection rings shown separated;

FIG. 9 is a cross-sectional profile of the rings of FIGS. 8A and 8B shown connected;

FIGS. 10A and 10B are cross-sectional profiles of a another pair of modified connection rings shown separated;

FIG. 11 is a cross-sectional profiles of the rings of FIGS. 10A and 10B shown connected;

FIGS. 12A and 12B are cross-sectional profiles of yet another pair of modified connection rings shown separated;

FIG. 13 is a cross-sectional profile of the rings of FIGS. 12A and 12B shown connected;

FIGS. 14A and 14B are cross-sectional profiles of yet another pair of modified connection rings shown separated;

FIG. 15 is a cross-sectional profile of the rings of FIGS. 14A and 14B shown connected;

DETAILED DESCRIPTION OF THE INVENTION

Figure 1:
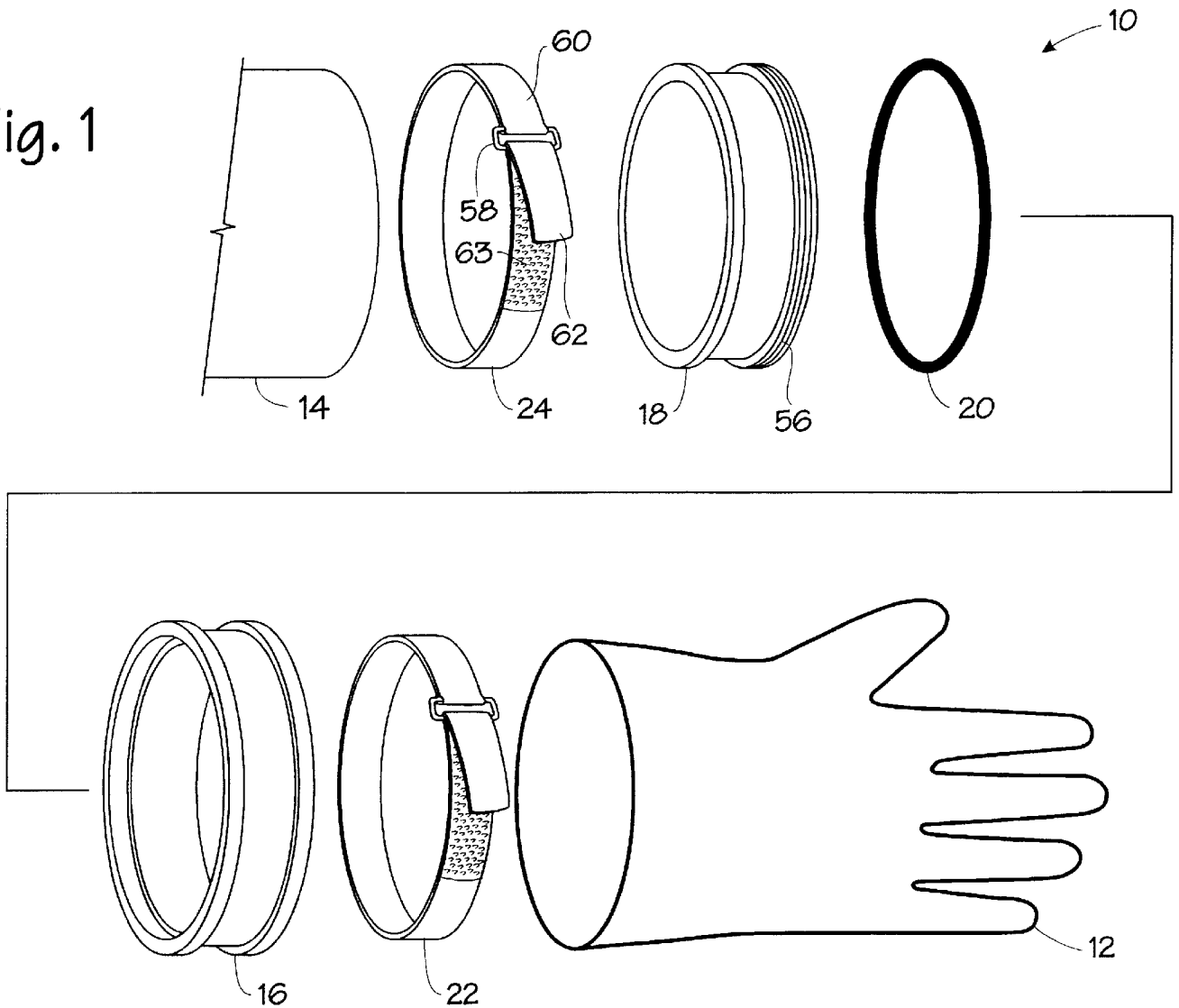
FIG. 1 is an exploded angular side view of the components which constitute the preferred embodiment of the subject invention shown with a glove and the cuff portion of a jacket sleeve.

Referring to FIG. 1, there is shown at 10 the preferred embodiment of the connection apparatus according to the present invention. The connection apparatus 10 is used to releasably connect in sealing relationship a glove 12 to the cuff 14 of a sleeve of a jacket, raincoat or similar apparel (not shown). In general, the preferred embodiment of the connection apparatus comprises a pair of generally rigid, annular rings 16, 18, a resilient sealing and retaining element 20, and a pair of bands or straps 22, 24.

The operational arrangement of the rings 16, 18 and the sealing and retaining element 20 are shown in more detail in FIGS. 2A, 2B, 3A and 3B. Ring 16 shown in FIG. 2B includes a generally circular central opening 26 and has an annular shoulder 30 so as to delineate first and second internal cylindrical surfaces 32, 34 of differing diameters $d_1$, $d_2$, respectively. A pair of annular flanges 36, 38 extend radially outwardly from the ends of the ring 16 thereby forming a circumferential channel 40 therebetween.

Figure 3B:
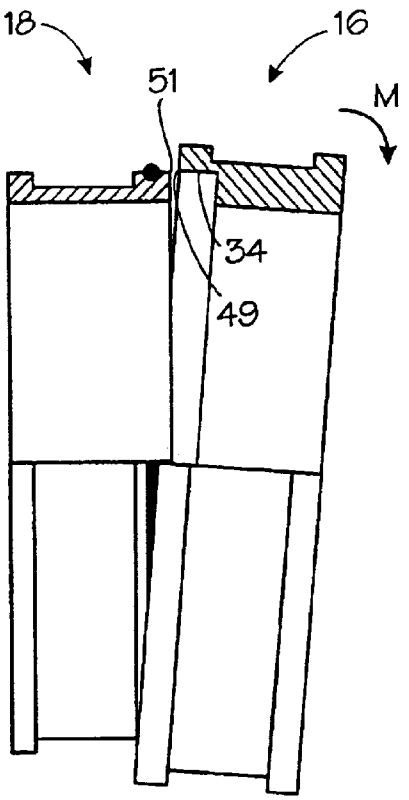
FIG. 3B is a partial cross-sectional side view showing the manner by which the ring sections can separate angularly.
Figure 3A:
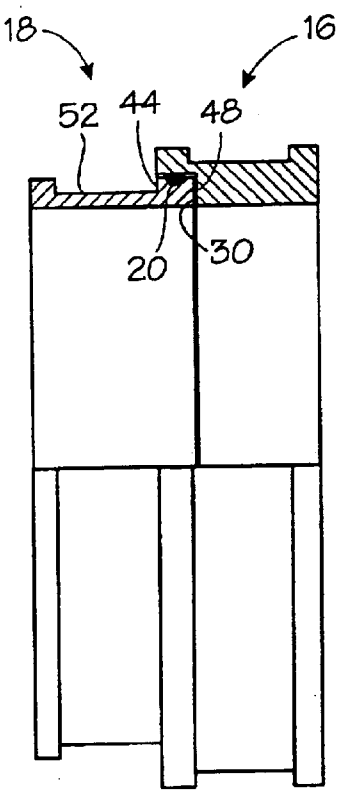
FIG. 3A is a partial cross-sectional side view showing the ring sections of the embodiment of FIG. 1 in their engaged position.
Figure 2B:
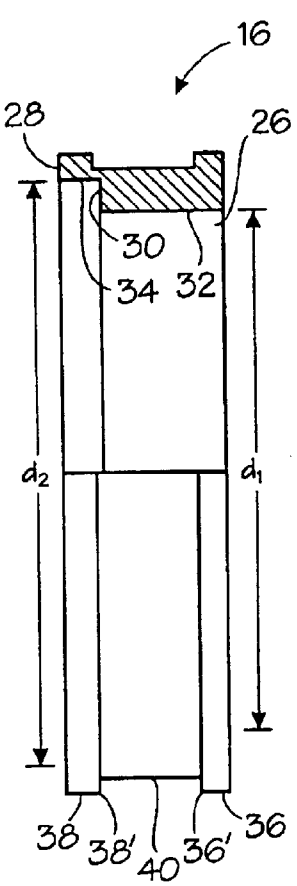
FIGS. 2A and 2B are detailed, partial cross-sectional side views of the disengaged individual ring sections of the embodiment of FIG. 1.
Figure 2A:
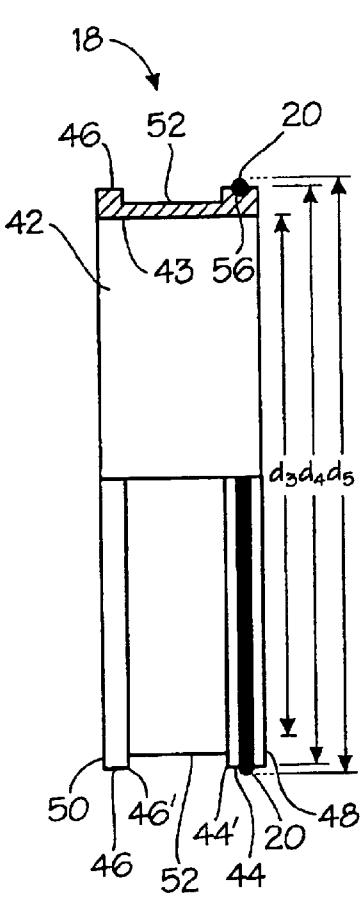
Figure 4A:
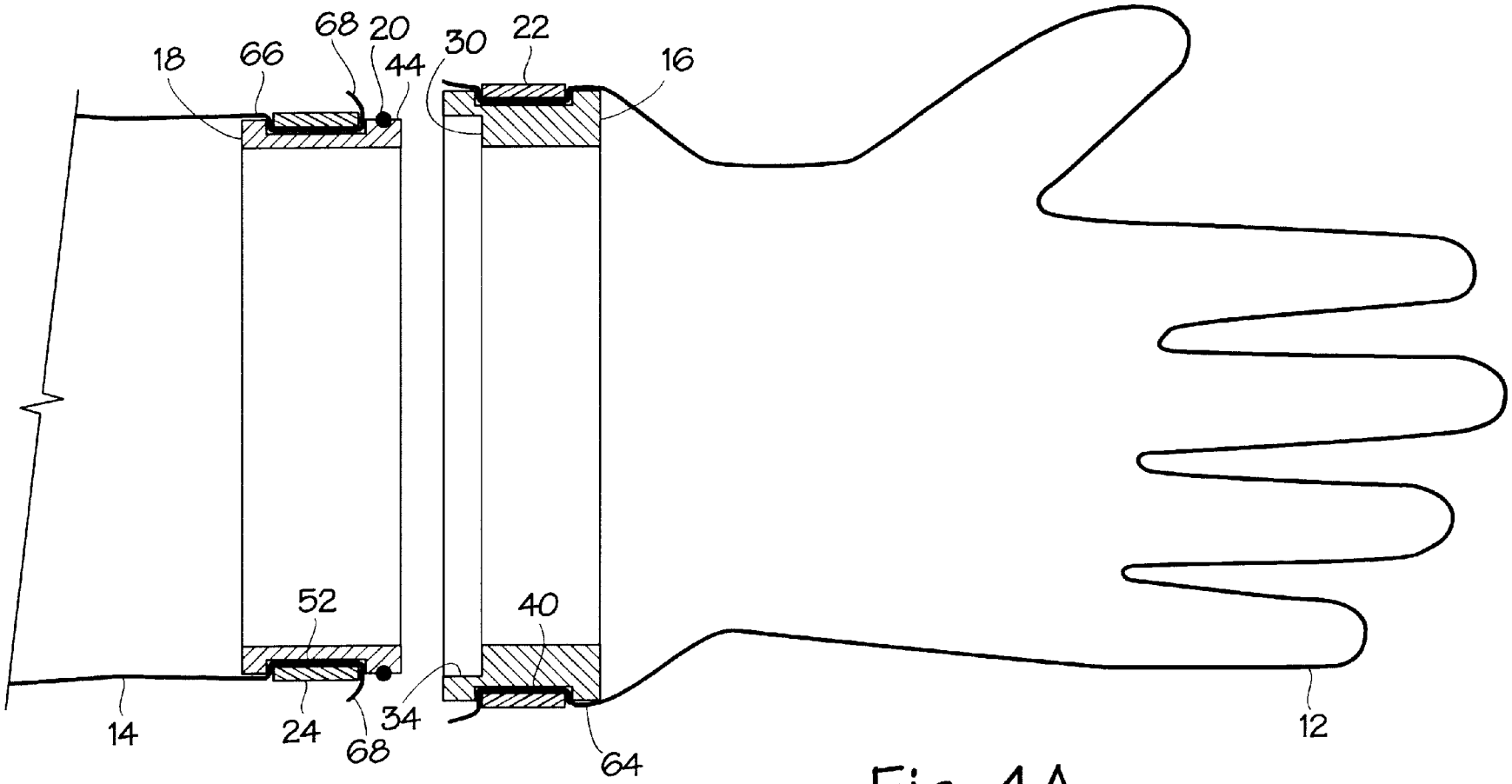
FIG. 4A is a cross-sectional side view of the disengaged connection apparatus illustrating the manner of attachment of the glove and the cuff to the respective ring sections.
Figure 4B:
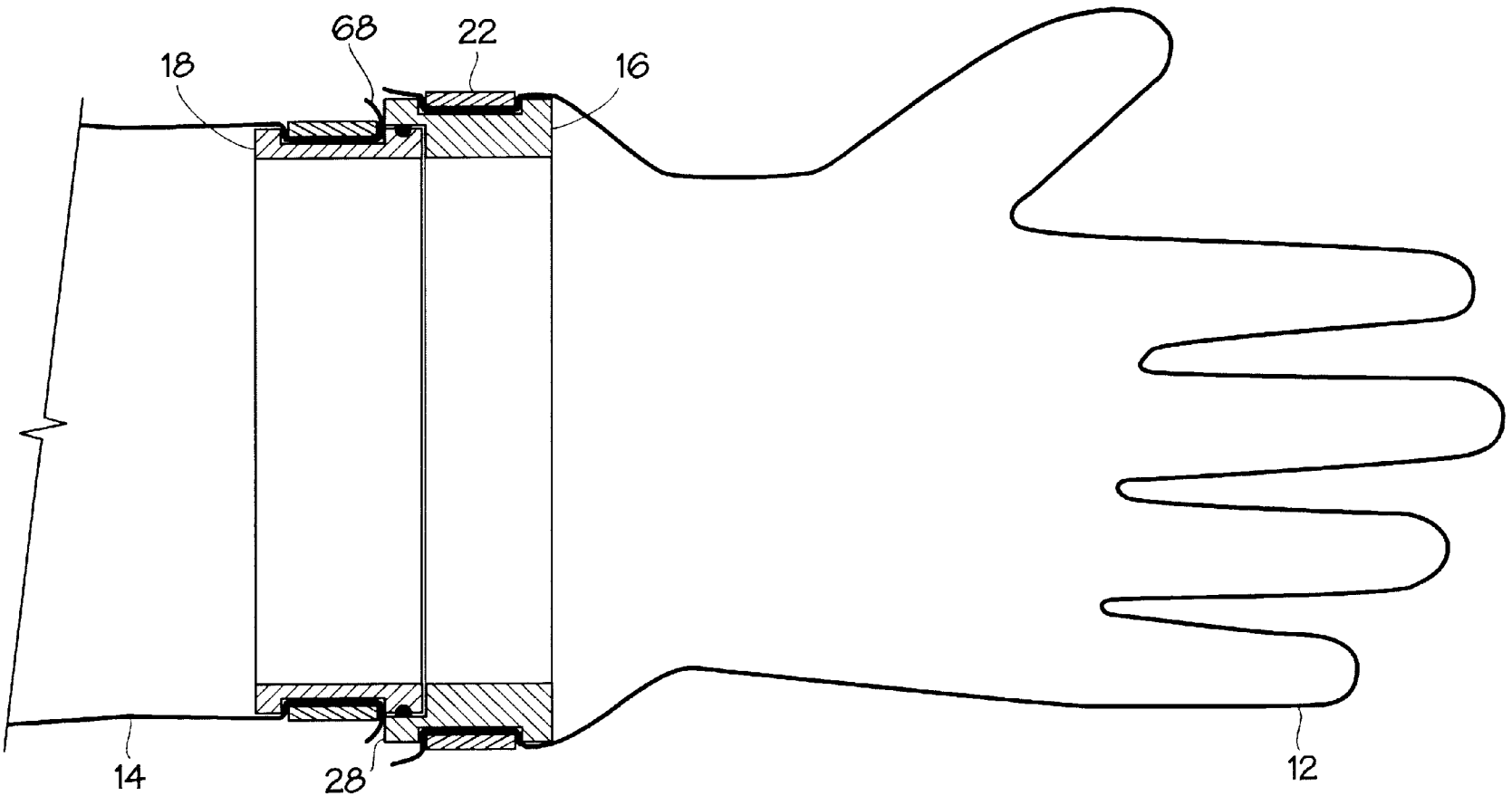
FIG. 4B is a cross-sectional side view similar to that shown in FIG. 4A, but showing the of the engaged connection apparatus and illustrating the manner in which the ring sections, and hence the glove and cuff, are sealingly connected.
Figure 4C:
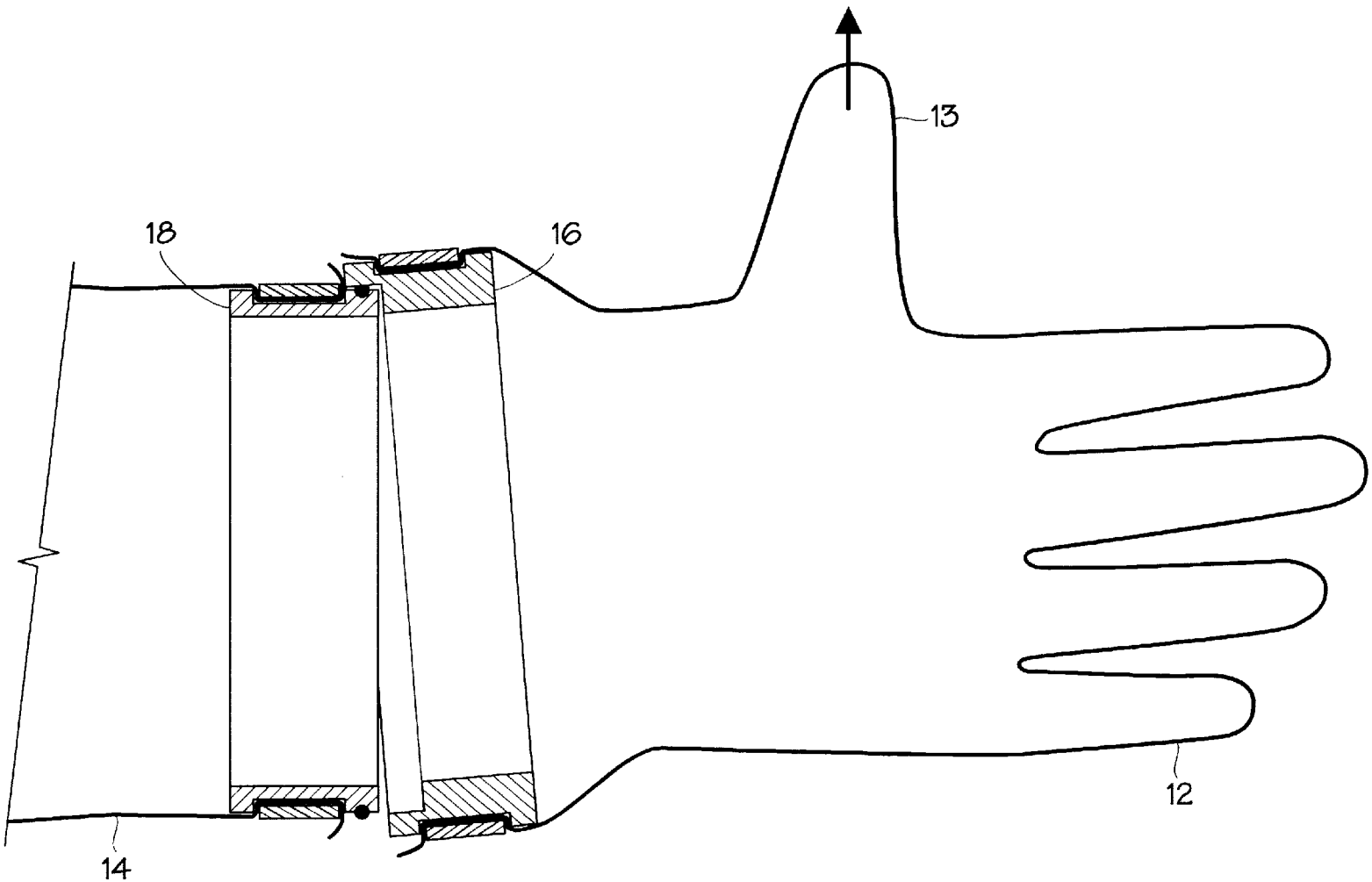
FIG. 4C is a cross-sectional side view of the connection apparatus angularly separating in response to a transverse force applied to the thumb of the glove.

Ring 18 shown in FIG. 2A includes a circular central opening 42 of substantially constant diameter $d_3$ which, preferably, is the same as diameter $d_1$ of ring 16 so a substantially contiguous surface forms upon connection of the rings as shown in FIG. 3A. The internal surface 43 of opening 42 of ring 18 along with the internal surface 32 of opening 26 of ring 16 should be smooth and comfortable as they will be in contact with the user's wrist and hand. Ring 18 has an annular flange 44 which extends radially outwardly at or near one end 48 of the ring 18, and a second annular flange 46 which extends radially outwardly from the other end 50 of the ring 18. Flanges 44, 46 form an external circumferential channel 52 therebetween. Flange 44 includes an annular recess 56 (see also FIG. 1) for seating the sealing and retaining element 20.

While the outside diameter $d_4$ of the flange 44 is less than the inside diameter $d_2$ of the larger internal cylindrical surface 34, the diameter $d_5$ to which the sealing and retaining element 20 extends when the rings 16, 18 are not in engagement is slightly greater than the inside diameter $d_2$ of the larger internal cylindrical surface 34, thereby causing the sealing and retaining element 20 to be compressed in a sealing and frictionally retaining manner against cylindrical surface 34 when the rings 16, 18 are engaged as shown in FIG. 3A. During insertion, the sliding of the compressed element 20 against the surface 34 serves to wipe the surface 34 clear of any foreign particles or liquid so neither will hinder disengagement or detract from the normal retention capability.

As shown in FIG. 3A, the shoulder 30 of ring 16 provides a stop against which the end 48 adjacent flange 44 abuts to limit the amount of insertion and to ensure channel 52 remains exposed for purposes which will be described hereinbelow. The location of the shoulder 30 is designed to minimize the amount of travel of the sealing and retaining element 20 along the cylindrical surface 34 during engagement and disengagement of the rings 16, 18. The travel distance should be sufficient to ensure full contact of the entire compressed width of element 20 against the surface 34 when in the engaged position which should prevent the sealing and retaining element 20, and hence the ring 18, from accidentally "popping" out of engagement with the ring 16 under normal use conditions. By minimizing the travel distance, the duration of a given force necessary to disengage the rings 16, 18 (as compared with a longer travel distance) is also minimized thereby enabling more ready disengagement of the rings 16, 18 should it be necessary for safety reasons. The location or depth of the shoulder 30 is also designed to ensure the amount of overlap/underlap does not hinder disengagement of the connection in circumstances where the separating force does not have a predominant axial component, thus causing a moment M or twisting force to be applied at the connection as shown in FIG. 3B. As will be demonstrated more clearly hereinbelow, the limit to which the inserted portion of one cylindrical ring can extend within the other cylindrical ring yet still enable pure angular disconnection is dependent on the difference between the external diameter of the inserted portion and the internal diameter of the overlapping portion, i.e. the amount of play between the overlapping/underlapping portions of the rings, as well as the shape of the inserted and overlapping portions. As shown in FIG. 3A, the insertion depth of ring 18 into ring 16 is limited by shoulder 30 while the outside diameter $d_4$ of the flange 44 is sufficiently less than the inside diameter $d_2$ of the larger internal cylindrical surface 34, so as to permit angular disconnection of the rings 16, 18 as shown in FIG. 3B. The difference in the diameters $d_2$ and $d_4$ is sufficient to permit clearance of the corners 49, 51 of the respective rings 16, 18 upon angular separation. If the shoulder 30 were provided at a deeper location (not shown), the difference in the diameters $d_2$ and $d_4$ would likely not be sufficient to prevent corner 51 from binding against surface 34 and preventing angular separation of the rings 16, 18.

Preferably, tightenable straps 22, 24 are used (see FIGS. 1 and 4A–4C) in order to attach the glove 12 to ring 16 and the cuff 14 to the ring 18, respectively. As shown in FIG. 1, the straps 22, 24 have a buckle 58 at one end 60 through which the distal end 62 is inserted and pulled to tighten. Preferably, the straps are provided with hook-and-loop-type fasteners 63 (such as Velcro™) so that the end 62 can be secured after tightening. Alternatively, the buckle itself can be such as to self tighten as the distal end 62 is pulled and can be provided with a release mechanism when withdrawal or loosening is desired. In any event, the specific form of the straps 22, 24 is not overly important. Their purpose is to serve as constriction or compression elements which hold the wrist portion 64 of glove 12 or the end 66 of the cuff 14 against the exterior of the rings 16, 18 and, thereby, serve to seal the wrist portion 64 of glove 12 or the end 66 of the cuff 14 to their respective rings 16, 18. Preferably, the straps 22, 24 entrap wrist portion 64 of glove 12 or the end 66 of the cuff 14 within the circumferential channels 40, 52, and between the respective flanges 36, 38 and 44, 46. In this regard, the widths of straps 22, 24 should be less than the widths of the channels 40, 52 to allow sufficient room for the thicknesses of the glove and cuff materials. Likewise, the depths of the channels 40, 52 should be sufficient to ensure the wrist portion 64 of the glove or the end 66 of the cuff 14 cannot easily be pulled off the respective rings 16, 18 when the straps 22, 24 have been applied and tightened. By providing flanges 36, 38, and 44, 46 with sharp, i.e. substantially square, edges 36', 38' and 44', 46' adjacent channels 40 and 52, respectively (see FIGS. 2A, 2B), additional retention capability is provided.

Similar constriction means, such as constrictive (elastic) bands or the like could also be employed as the constricting elements for attaching the glove 12 and cuff 14 to their respective rings 16, 18, although the Velcro™ straps are preferred due to their ease of use.

Since both the glove 12 and cuff 14 are preferably made from waterproof materials, the compressive force of the tightened straps 22, 24 should suffice to attain a water-resistant, if not waterproof seal between the glove 12 and the ring 16 and between the cuff 14 and the ring 18.

As aforesaid, by configuring the relationship between the flange 44 and shoulder 30 to the ensure the channel 52 is exposed, i.e. not inserted into ring 16, access to the strap 24 is guaranteed whether or not the rings 16, 18 are engaged. This arrangement also serves to ensure that if any overhang 68 of the end 66 of cuff 14 exists which projects beyond strap 24, it is kept from interfering with the engagement or disengagement operations since it is pushed out of harm's way by the end face 28 of the ring 16. While separation of the rings 16, 18 can occur axially under a force of predetermined magnitude and duration, in circumstances where the separating force does not have a predominant axial component, for example if the thumb 13 of the glove 12 was pulled transversely (see FIG. 4C), thus causing a moment or angular twisting force to be applied at the connection, the rings 16, 18 can disengage angularly, thereby permitting detachment of the glove from the cuff in a safe manner.

The rings 16, 18 can generally be made from any suitable material which is relatively lightweight and unaffected by exposure to water. The material should be sufficiently rigid to withstand the pressures applied by straps 22, 24 for securing the glove and cuff thereto. The material should be selected to ensure an appropriate coefficient of friction with respect to the material of the sealing and retaining element 20 for retaining and releasing purposes. Although the rings 16, 18 can be machined, moulding such as by plastic injection is preferred due to its economy of scale. A commonly available O-ring can serve as the sealing and retaining element 20. The O-ring should be sufficiently resilient to be compressible in a sealing relationship against the inner surface 34 and sufficiently elastic so as to remain seated in the annular recess 56 provided therefor in the flange 44. Dimensions and finishes for the various components are selected to ensure the hand and wrist can be easily and comfortably accommodated and with standard glove and sleeve sizes in mind.

Because the sealing and retention mechanism is designed between the rings, the mechanism can be engineered to be separable at a predetermined separating force threshold and manufactured in a quality-controlled environment for to ensure consistency and reproducibility of release. The design separating force is "predetermined" to be an amount greater than the nominal force need for maintaining the connection during normal working conditions but not so great as to prevent a wearer from effecting the disconnection, which should be somewhat difficult but not impossible. Such a predetermined separating force should be appropriate to enable disengagement of the rings either axially or angularly, and hence separation of the cuff and glove should the glove be caught in machinery or the like.

Figures 5A, 5B, 5C, 5D:
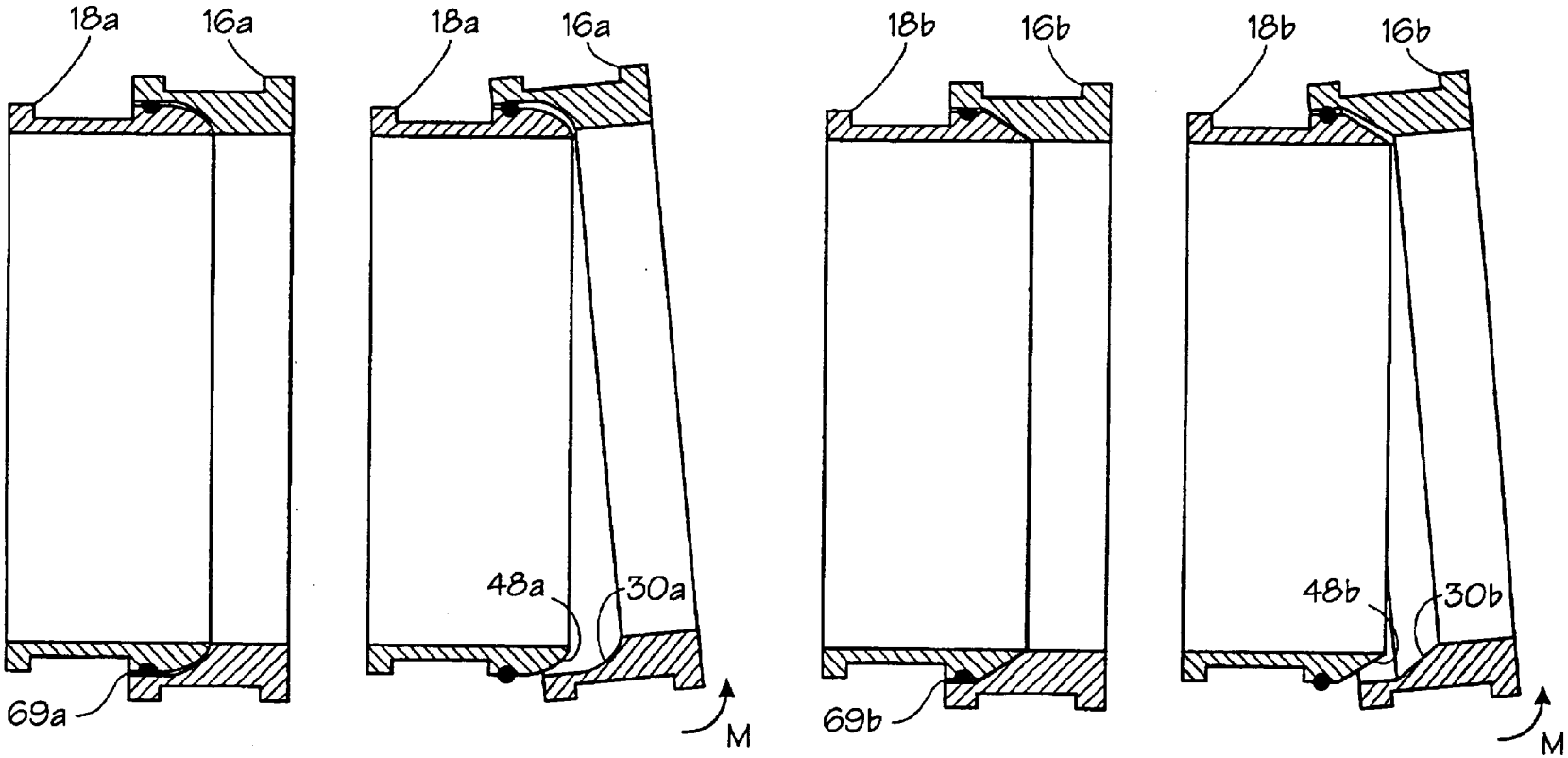
FIGS. 5A and 5B are cross-sectional side views of a modified pair of connection rings illustrating their connection and angular disengagement.
FIGS. 5C and 5D are cross-sectional side views of another modified pair of connection rings illustrating their connection and angular disengagement.

In FIGS. 5A and 5B, the insertable portion of the ring 18*a* is provided with an alternate configuration having an arcuate leading edge 48*a* which is adapted to abut against a corresponding arcuate shoulder 30*a*. Similarly, the insertable portion of the ring 18*b* in FIGS. 5C and 5D, is provided with an alternate configuration having a tapered leading edge 48*b* which is adapted to abut against a complementary tapered shoulder 30*b*. The spacings 69*a*, 69*b* located between respective pairs of rings 16*a*, 18*a* and 16*b*, 18*b* are sufficiently large to ensure angular separation of each should the need arise. Such shapes facilitate registration of the insertable portion within the overlapping portion and, hence, permits easier engagement of the rings.

Figures 6A, 6B, 6C, 6D:
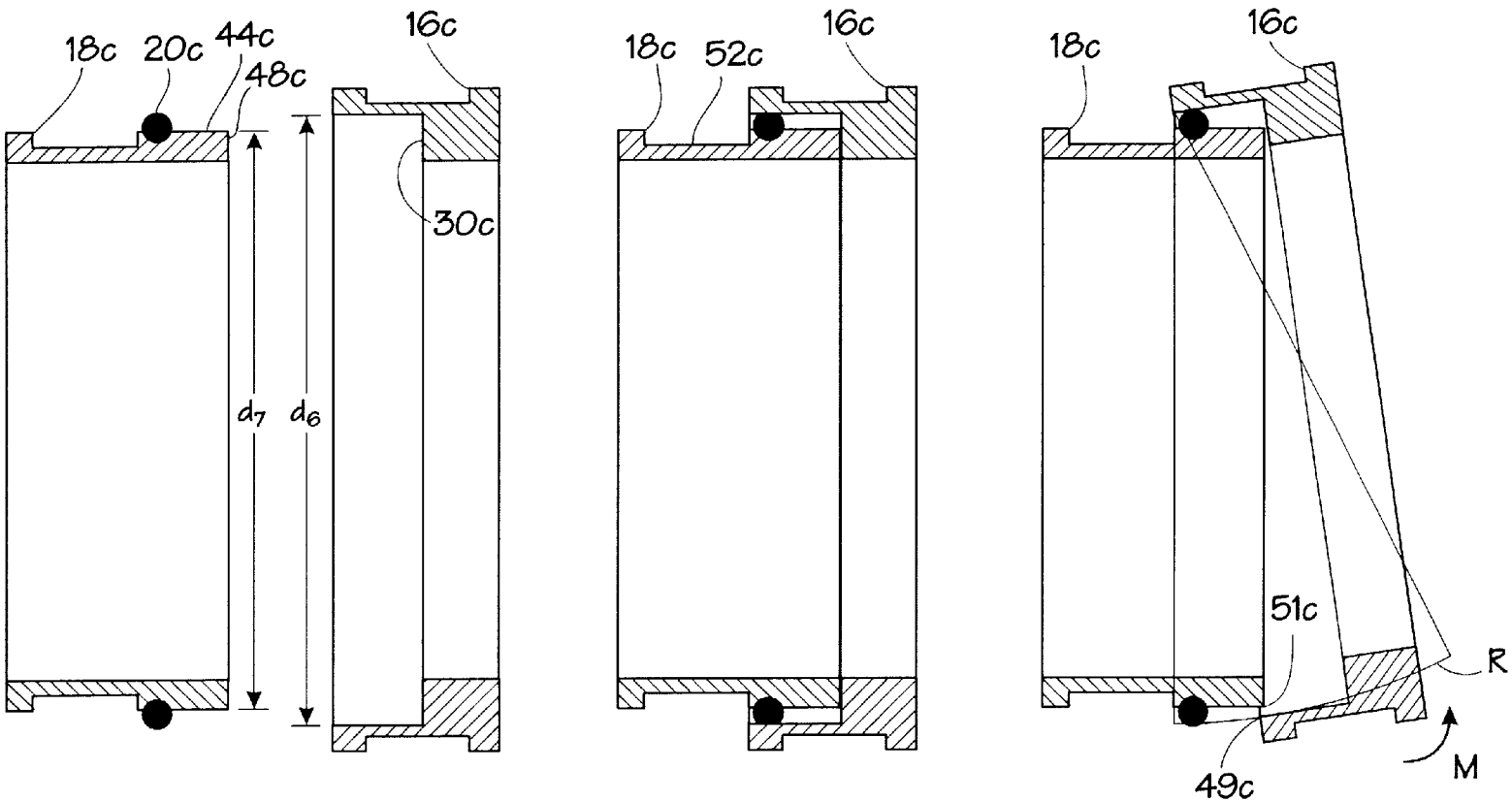
FIGS. 6A–6D are cross-sectional side views of another pair of modified connection rings illustrating their connection and angular disengagement.

As mentioned above, the limit to which a portion of one rigid ring is insertable within another whilst ensuring that angular separation of the rings can occur is dependent to a great extent on the diametrical differences between the rings. In FIGS. 6A–6D, there is provided a first ring 16*c* having an opening of diameter $d_6$ and a second ring 18*c* having an annular flange 44*c* of a lessor diameter $d_7$ which supports o-ring 20*c*. The difference between $d_6$ and $d_7$ is greater than the difference between $d_2$ and $d_3$ of rings 16, 18 shown in FIGS. 2A and 2B. The greater difference is bridged by a larger o-ring 22*c* which provides the sealing and retaining function. Due to the greater diametrical difference, annular flange 44*c* can be extended as compared with annular flange 44 of ring 18 of FIG. 2A. The depth at which the shoulder 30*c* is located can be made to correspond substantially with the width of the annular flange 44*c* so that when rings 16*c* and 18*c* are engaged, channel 52*c* remains exposed as shown in FIG. 6C. While the amount of overlap/underlap shown in FIG. 6C is considerably more than that shown in FIG. 3A, the greater diametrical difference still permits angular disengagement of the rings 16*c*, 18*c* as shown in FIG. 6D because the path R that corner 49*c* follows during angular disengagement remains beyond the extremities of ring 18*c*, such as corner 51*c*.

Figures 7A, 7B, 7C, 7D:
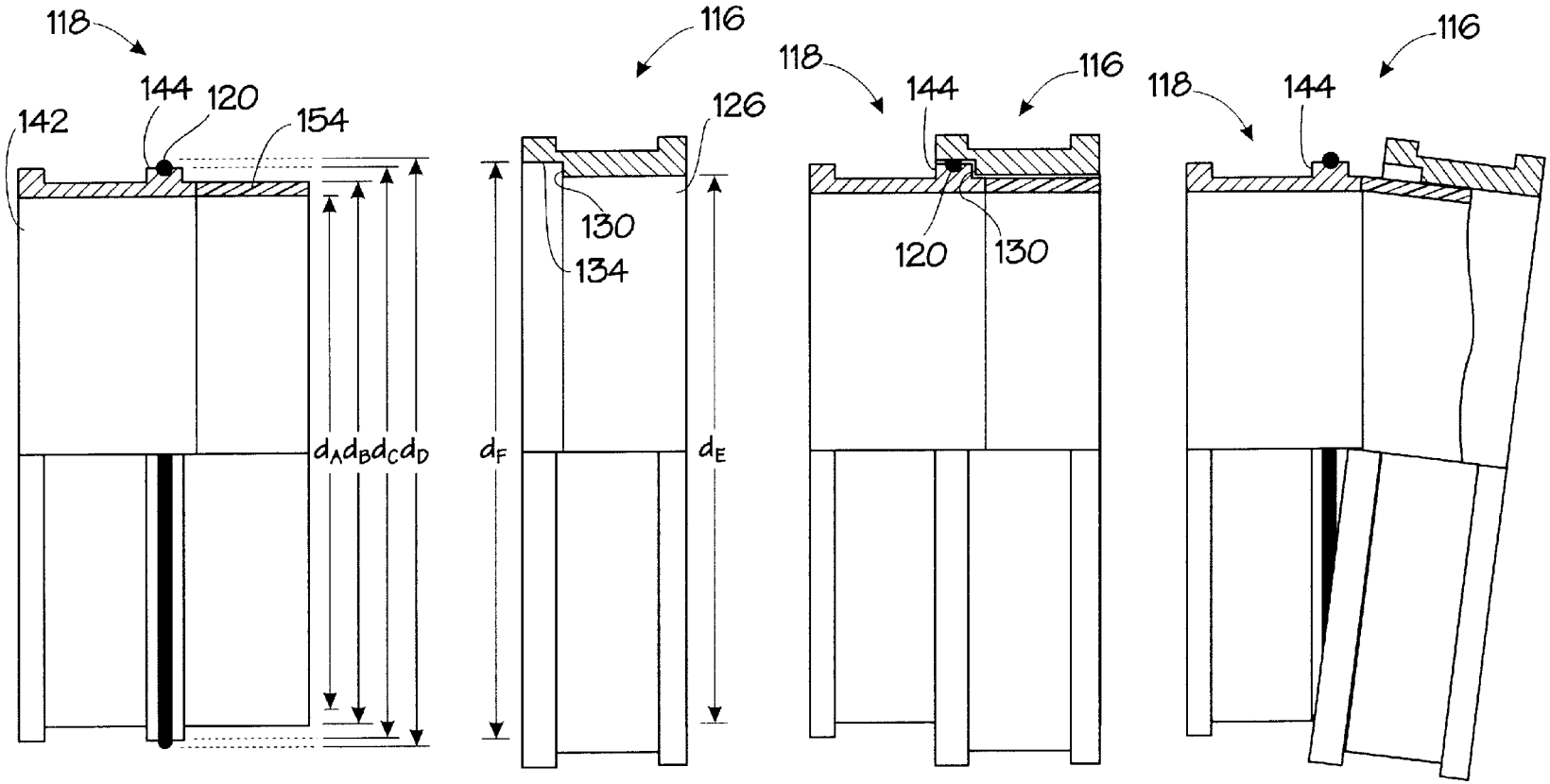
FIGS. 7A–7D are partial cross-sectional side views of yet another pair of modified connection rings illustrating their connection and angular disengagement.

An alternate embodiment of the angularly disengageable glove-to-cuff connection apparatus is shown in FIGS. 7A–7D. As compared with ring 18 of FIG. 2A, ring 118 includes a flexible extension portion 154 extending generally from the annular flange 144 so as to provide an opening 142 of substantially constant diameter $d_A$ through the ring 118. The outside diameter $d_B$ of cylindrical end portion 154 of ring 118 is less than the inside diameter $d_E$ of the ring 116 to facilitate registration of the annular central flange 144 and its associated sealing and retaining element 120 of ring 118 within the larger internal cylindrical surface 134 of the ring 116 as shown in FIG. 7C. While the outside diameter $d_C$ of the central flange 144 is less than the inside diameter $d_F$ of the larger internal cylindrical surface 134, the diameter $d_D$ to which the sealing and retaining element 120 extends when the rings 116, 118 are not in engagement is slightly greater than the inside diameter $d_F$ of the larger internal cylindrical surface 134, thereby causing the sealing and retaining element 120 to be compressed in a sealing and frictionally retaining manner against cylindrical surface 134 when the rings 116, 118 are engaged. As shown in FIG. 7C, when rings 116, 118 are engaged, the opening 142 forms the entire inner surface of the connection, thereby eliminating any possibility of pinching of skin or clothing. The extension 154 is formed of a flexible material capable of being seamlessly welded, fused or otherwise connected to the remaining rigid ring portion. The flexibility permits the extension portion 154 to deflect and/or partially collapse as shown in FIG. 7D so as not to inhibit angular disengagement in cases where the extent to which the ring 118 is inserted in the ring 116 in conjunction with the amount of play between the rings would be insufficient to permit angular disconnection had the extension portion 154 been formed entirely of rigid material.

FIGS. 8A and 8B show a cross-sectional portion of pair of disengaged rings 16*d*, 18*d* similar to the rings 16, 18 of FIGS. 2A and 2B. However, in this embodiment, the inner surface 34 of ring 16*d* includes an annular recess or locating groove 70. During engagement of the rings 16*d*, 18*d* as shown in FIG. 9, the sealing and retaining element 20 seats within groove 70 to provide a more positive location between the rings 16*d*, 18*d*. Thus, in this embodiment, the retention of rings is not effected by friction alone.

For comfort and safety, certain edges of the rings may be rounded, particularly those internal edges which might be in contact with the wearer, and exposed outer edges. As exemplified in FIGS. 8A, 8B and 9, rings 16*d*, 18*d* are provided with rounded internal edges $R_1$–$R_4$. Rounded distal edges $R_1$ and $R_2$ would help guard against abrasion of the wearer's skin or prevent catching on any clothing being worn such as shirt sleeves. Rounded proximal edges $R_3$ and $R_4$ would help prevent potential pinching of skin or clothing between abutting portions of rings 16*d* and 18*d* when they are being connected. A rounded edge $R_5$ may be provided on ring 16*d* on the external edge which is exposed when the rings 16*d*, 18*d* are connected. Furthermore, the distal external edges of rings 16*d*, 18*d* may be provided with rounded edges $R_6$ and $R_7$ to lessen local strain on the glove and cuff material.

A variation of the sealing and retention arrangement of the rings 16*d*, 18*d* of FIGS. 8A, 8B and 9 is shown in FIGS. 10A, 10B and 11 wherein in lieu of a separate o-ring 20, a bead 20' is provided integrally on the ring 18*e* which cooperates with the seating groove 70' provided in ring 16*e*. The bead 20' and/or the flange 71 may be somewhat resilient or flexible to compress or expand, respectively, to permit the relative insertion of the ring 18*e* within the ring 16*e* and so that the bead 20' sealingly seats in the groove 70' as shown in FIG. 11.

It has been found that the sealing and connection function between the cuff ring and the glove ring can also be effected by providing cooperating annular flanges 72, 74 as shown on disengaged rings 16*f*, 18*f* in FIGS. 12A and 12B. Flange 72 is disposed outwardly of flange 74 and is provided with a projection 76 on its inward periphery while flange 74 is provided with a projection 78 on its outside periphery. The inside diameter of the annular projection 76 is less than the outside diameter of the annular projection 78. At least one of the flanges 72, 74 and/or the projections 76, 78 are sufficiently resilient to cause it to flex when the rings 16*f*, 18*f* to be pushed together as shown in FIG. 13 to enable the projections 76, 78 to slide over and behind one another (i.e. over-centered) into a secure position. By selecting appropriate dimensions between the ends 80, 82 and the projections 76, 78, it will be possible to cause at least one of the ends 80, 82 to forceably abut in a sealing manner the opposed flange 44*f* (as shown in FIG. 13) or the opposed shoulder 30*f*, respectively, (or some other opposed portion of the opposite ring) as the projections 76, 78 over-center against one another. In this regard, the sealing and retaining capability of this connection functions in a similar manner as plastic push-on/snap-on covers for containers.

A similar arrangement is provided in the embodiment shown in FIGS. 14A, 14B and 15. In this case, the sealing connection between rings 16*g* and 18*g* is realized by providing one of the rings, i.e. ring 18*g*, with an axially projecting annular flange 84 having at its end a bead 86. The other ring, i.e. ring 16*g*, has a pair of annular flanges 88, 90 that extend so as to form therebetween an annular slot 92 that terminates in an enlarged end portion or cavity 94 shaped to accommodate bead 86. When the flange 84 is inserted between flanges 88, 90, one or both of the flanges 88,90 flex outward with respect to one another as the bead 86 moves between them initially. The rounded shapes of the bead 86 and the enlarged end portion 94 cause the bead 86 to be drawn into enlarged end portion 94 and the flanges 88, 90 to retract to surround the bead 86 when the bead 86 reaches the enlarged end portion 94. The lengths of the flanges 84, 88, 90 are such that the ends of the flanges 88, 90 of ring 16*g* will be compressed against the shoulders 96 of ring 18*g* as shown in FIG. 15 whereby both an effective seal and connection between the rings 16*g*, 18*g* are provided.

In any of the embodiments shown in FIGS. 9, 11, 13 and 15, when a separating force which is generally axially directed, or consists of a moment or a combination of both, acts on the rings which is of sufficient magnitude, the respective resilient elements 20; 20', 71; 72, 74; 88, 90 flex so as to disengage the one ring from the other.

Depending on the construction of the sleeve/cuff, it may be possible to retain and seal the cuff ring in situ with an appropriate modification of the cuff ring without the need for a separate retention element. For example, a sleeve that has a cuff or cuff opening of limited stretchability could in general retain a cuff ring if the cuff ring were provided with a portion of greater width than the maximum width of the cuff or cuff opening. The retention is provided by the inability to force the expanded portion through the limited opening. In this regard, there is shown in FIG. 16A a modified cuff ring 218 similar to cuff ring 18 of FIG. 2A. An annular ridge 244 is provided which includes an annular groove 256 for seating the sealing and retention element (i.e O-ring) 120. A frustoconical extension 252 flares outwardly from the ridge 244 to a distal end 248 of diameter $d_9$.

Figure 16B:
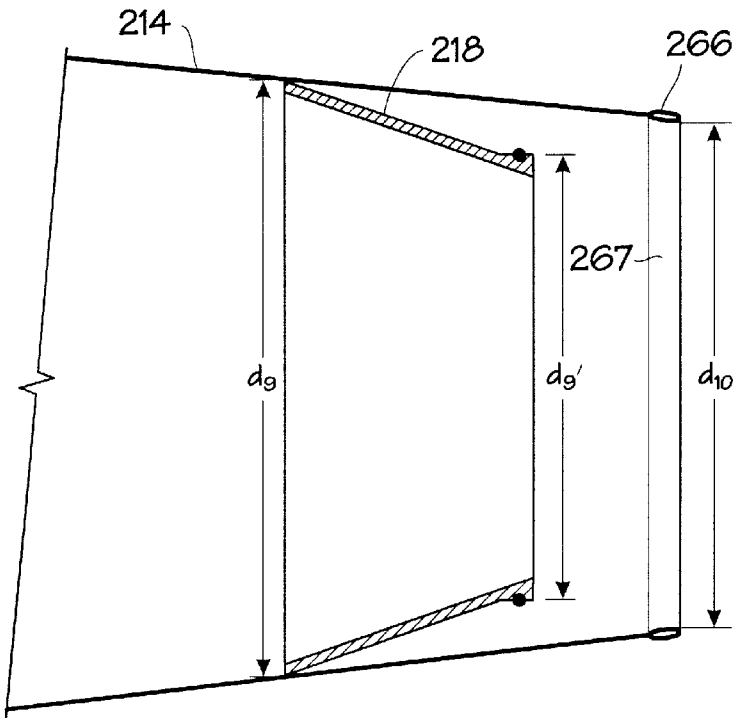
FIG. 16B is a partial cross-sectional view of a tapered sleeve with the modified cuff ring of FIG. 16A in the process of being inserted therein.
Figure 16A:
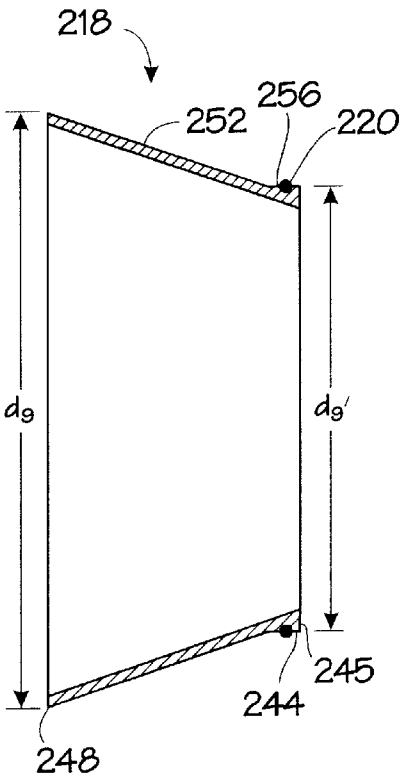
FIG. 16A is a cross-section of a modified form of cuff ring designed for use with a tapered sleeve.
Figure 17:
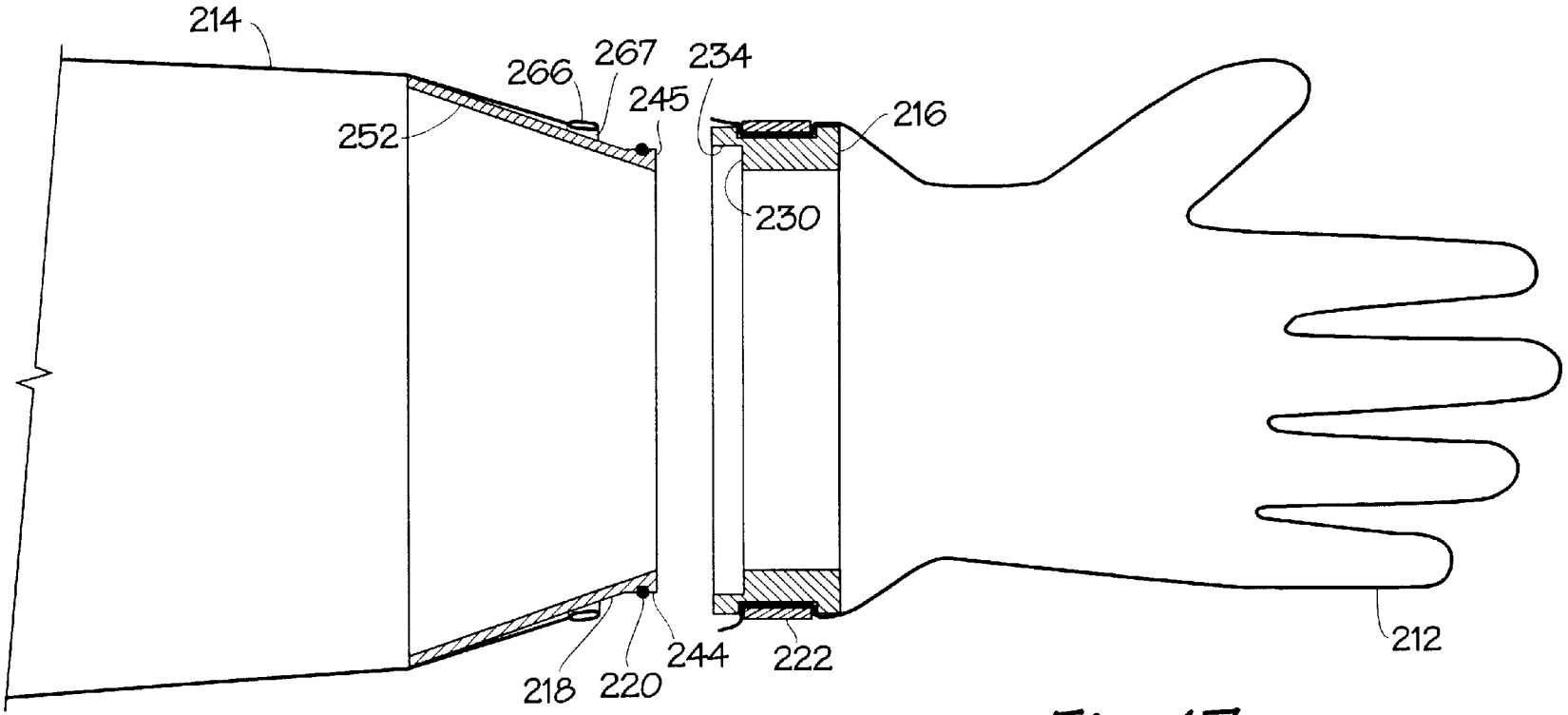
FIG. 17 is a partial cross-sectional view of the tapered sleeve showing the modified cuff ring of FIG. 16A retained therein and in disengaged relationship with its associated glove and respective ring portion of the connection apparatus.

FIG. 16B shows the insertion of cuff ring 218 into the cuff portion 214 of a tapered sleeve. The cuff 214 terminates in an end opening 266 that has a limited or maximum opening width or diameter $d_{10}$ which is sufficiently less than the width or diameter $d_9$ of the end 248 of cuff ring 218 to ensure that the cuff ring 218 cannot be pulled/pushed entirely through the cuff ring end 248. When "tapered" is referred to herein with respect to the sleeve and/or cuff, it means that the portion of the cuff inward of its end opening either has, or can extend/stretch to, a greater internal diameter than the limited diameter of the end opening. As the cuff ring 218 is continued to be pulled/pushed toward the end opening 266 of the cuff 214, it becomes wedged or jammed therein due to the slope of the frustoconical extension 252 as shown in FIG. 17, providing a substantially waterproof fit. Thus the cuff ring 218 can be retained by the cuff 214 provided there is a portion of the cuff ring 218 which is greater in dimension than the maximum dimension to which the opening 266 and where the portion of the cuff 214 inward of its end opening 266 either has, or can extend/stretch to, a greater internal diameter than the limited diameter of the end opening 266. The end 266 of the cuff 114 may include a seam 267, which may or may not include an elastic or is itself elasticized but regardless of which, it is limited to expand to a diameter $d_{10}$ no greater than the maximum diameter $d_9$ of the cuff ring 218.

Figure 18:
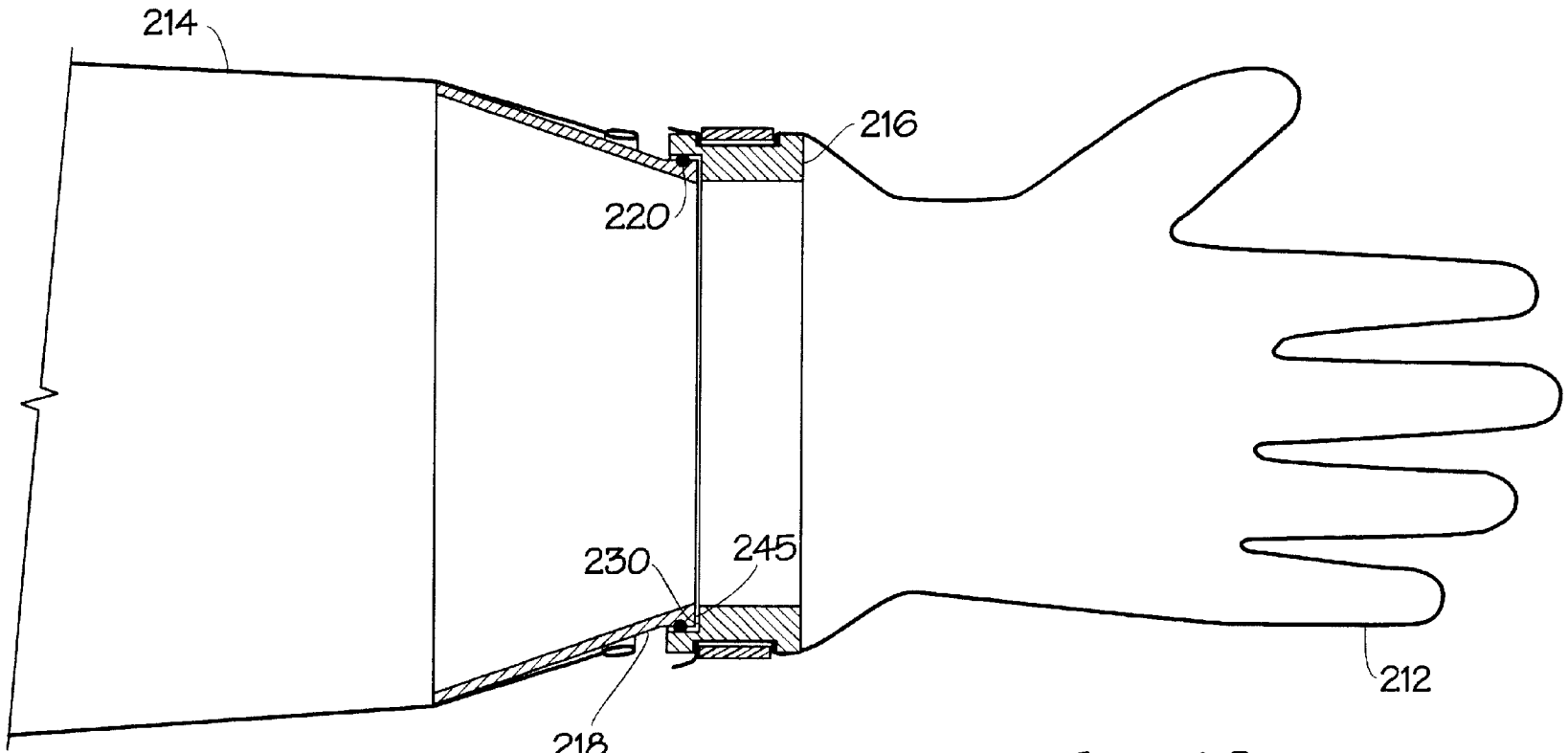
FIG. 18 is a cross-section showing the connection apparatus of FIG. 17 engaged and illustrating the manner in which the ring sections, and hence the glove and cuff, are sealingly connected.

As shown in FIG. 16B, the slope of the frustoconical extension 252 is designed for a given sleeve/cuff arrangement to ensure that its lesser diameter $d_9'$ is less than the limited opening diameter $d_{10}$ of the cuff opening 266 and to ensure that the ridge 244 protrudes through or is accessible through the cuff opening 266 when the cuff ring 218 is wedged therein. In that way, a glove 212 attached to a glove ring 216 which is, in general, the same arrangement shown in FIG. 4 can readily be connected to the cuff ring 216 as illustrated in FIGS. 17 and 18. Ridge 244 of cuff ring 218 has a shoulder 245 which abuts the shoulder 230 of the glove ring 216 to limit the length of insertion of the cuff ring 218 within the glove ring 216 while the o-ring 220 compresses sealingly against the internal cylindrical surface 234 to frictionally retain the rings 216, 218 together in the same manner as the arrangement shown in FIGS. 4 and 5. Similarly, the rings 216,218 are disengageable under application of a predetermined axial and/or an angular force of sufficient magnitude and duration to overcome the frictional retention.

Thus while there has been shown and illustrated several embodiments of an apparatus for releasably securing a glove to a cuff, the cuff and the glove are not attached or sealed specifically to one another but rather each are sealingly connected to one of a pair of rings and it is the rings which are sealingly connected to prevent ingress of water between the cuff and glove. It will be appreciated that in most of the embodiments illustrated herein, it is immaterial as to which ring the cuff or the glove is connected as the rings can simply be attached to either. Furthermore, while the rings have been shown to be generally circular, it will be appreciated that the shapes could be elliptical if desired. Notwithstanding that fact that the various paired-ring embodiments described herein are all capable of angular disengagement, it will be appreciated that axial disengagement or a combination of axial and angular disengagement could occur, depending on the forces applied to the connection and is an inherent feature of the invention.

I claim:

1. An apparatus for releasably securing a glove to a cuff comprising:

a first ring sealingly attachable to a cuff and second ring sealingly attachable to a wrist portion of a glove, one of said rings having an insertable portion which is insertable within a receiving portion of the other said ring, there being a circumferential space between at least a part of said insertable portion and said receiving portion, connecting means for releasably and sealingly connecting said rings together when said insertable portion is inserted within said receiving portion to prevent ingress of water between said rings, said rings including stop means for limiting the extent to which said insertable portion is insertable within said receiving portion so as to permit angular disengagement of said rings under application of a predetermined angular force or moment on said rings.

2. The apparatus of claim 1, wherein said one of said rings includes a resilient sealing element which is compressible against a portion of the other ring for sealing said rings.

3. The apparatus of claim 2, wherein the compression of the resilient sealing element frictionally retains the rings together.

4. The apparatus of claim 3, wherein said resilient sealing element is a compressible o-ring.

5. The apparatus of claim 1, wherein said connecting means comprises:

a resilient sealing element disposed in a groove on an outer surface of said insertable portion; and an inner annular surface provided within said receiving portion against which said sealing element is compressible when said insertable portion is inserted within said receiving portion.

6. The apparatus of claim 5, wherein said resilient sealing element is a compressible o-ring.

7. The apparatus of claim 6, wherein an annular seating groove is provided in said inner annular surface for locating said o-ring when said one ring is inserted in said other ring.

8. The apparatus of claim 1, wherein said connecting means comprises:

an annular resilient bead formed integrally on said outer surface of said insertable portion; and an inner annular surface provided within the receiving portion having an annular seating groove in which said resilient bead is compressible when said insertable portion is inserted within said receiving portion to provide sealing and retention between said rings.

9. The apparatus of claim 1, wherein said connecting means comprises:

a first axially-projecting annular flange disposed on said insertable portion, said first flange including a radially outwardly extending projection; and a second axially-projecting annular flange disposed on said receiving portion, said second flange including a radially inwardly extending projection, said second flange being positioned with respect to said first flange such that said inwardly extending projection extends radially inwardly of said outwardly extending projection of said first flange, wherein at least one of said first or second flanges flexes to permit said projections to move over and behind the other when said rings are pushed together to seal and retain said rings together.

10. The apparatus of claim 1, wherein said insertable portion is formed as an axially-projecting annular flange on one said ring, and wherein said receiving portion is formed by a pair of axially-projecting annular flanges extending from said other ring and forming an annular slot therebetween, said connection means comprising:

a rounded bead disposed on the end of said axially-projecting annular flange, said bead being of greater thickness than the thickness of said axially-projecting annular flange, and a rounded cavity disposed at the base of said slot, said cavity being of the same general shape and size as said rounded bead, wherein at least one of said flanges of said pair is sufficiently flexible so that when said rings are pushed together, said annular flange of said one ring is received in said slot between said pair of flanges and said rounded bead is sealingly retained in said cavity.

11. The apparatus of claim 1, wherein said insertable portion terminates in a flexible extension which is deflectable during angular disengagement of said rings.

12. The apparatus of claim 1, wherein said stop means is in the form of an internal annular shoulder provided in said receiving portion against which said insertable portion abuts when said rings are engaged.

13. The apparatus of claim 12, wherein said shoulder is rounded and the insertable portion has a correspondingly rounded leading end.

14. The apparatus of claim 12, wherein said shoulder is tapered and the insertable portion has a correspondingly tapered leading end.

15. The apparatus of claim 1, wherein said one ring has an external circumferential channel against which the cuff can be held by a first constriction means; and wherein said other ring has an external circumferential channel against which the wrist portion of said glove can be held by a second constriction means.

16. The apparatus as claimed in claim 15, wherein said first and second constriction elements are tightenable straps.

17. The apparatus as claimed in claim 16, wherein said tightenable straps include a hook-and-loop type fastener mechanism to secure and maintain the strap in position when tightened.

18. The apparatus as claimed in claim 17, wherein said external circumferential channels of said rings and therefore said first and second constriction elements are both accessible when said rings are engaged.

19. An apparatus for releasably securing a glove to a cuff comprising:

a first ring sealingly attachable to a cuff and second ring sealingly attachable to a glove, said first and second rings being releasably and sealingly connectable to one another to prevent ingress of water therebetween, and said rings being angularly disengageable from one another upon application of an angular separating force of predetermined magnitude and duration.

20. The apparatus as claimed in claim 19, wherein one of said rings is partially insertable within the other ring.

21. The apparatus as claimed in claim 20, wherein said rings include stop means for limiting the extent to which said one of said rings is insertable within other ring.

22. The apparatus as claimed in claim 21, wherein said first ring has an outer surface against which a first constriction element compresses the cuff and wherein said second ring has an outer surface against which a second constriction element compresses a wrist portion of said glove.

23. The apparatus as claimed in claim 22, wherein the outer surface of each said first and second ring includes an external circumferential channel in which a respective one of said constriction elements is circumferentially positionable.

24. The apparatus as claimed in claim 23, wherein said first and second constriction elements are tightenable straps.

25. The apparatus as claimed in claim 24, wherein said tightenable straps include a hook-and-loop type fastener mechanism to secure and maintain the strap in position when tightened.

26. The apparatus of claim 19, wherein one of said rings includes a resilient sealing element which is compressible against a portion of the other ring for sealing said rings.

27. The apparatus of claim 26, wherein the compression of the resilient sealing element frictionally retains the rings together.

28. The apparatus of claim 27, wherein said resilient sealing element is a compressible o-ring.

29. The apparatus of claim 21, wherein said cuff has an end opening which is openable to a limited width and wherein said first ring includes an outwardly flaring frustoconical extension having a smaller end and a larger end, said smaller end having a width which is less than said limited width of said end opening of said cuff and said larger end having a width which is wider than said limited width of said end opening of said cuff, whereby pushing or pulling the cuff ring from within the cuff through said end opening wedges said frustoconical extension of said cuff ring sealingly in said end opening of said cuff.

30. An apparatus for releasably securing a glove to a cuff comprising:

a first ring, said first ring having an external circumferential channel against which a cuff can be held by a first constriction means;

a second ring, said second ring having an external circumferential channel against which a wrist portion of a glove can be held by a second constriction means, said second ring being coaxially insertable at least in part within said first ring so as to form an overlap between the rings;

sealing and retention means provided on an external circumferential surface of said first ring compressible against an internal circumferential surface of said second ring for releasably retaining said second ring in sealing engagement with said first ring, said internal circumferential surface of said second ring being spaced apart from said external circumferential surface of said first ring; and stop means for limiting the extent of insertion of said second ring whereby the amount overlap of said first ring with respect to said second ring in conjunction with the spacing between said internal circumferential surface of said second ring and said external circumferential surface of said first ring is sufficient so as to permit angular disconnection of said rings upon application of an angular separating force or moment of predetermined magnitude and duration.

31. The apparatus of claim 30, wherein said first and second constriction means sealingly compress the cuff and the wrist portion of a glove into said respective external circumferential channels.

32. The apparatus of claim 31, wherein said first and second constriction means are tightenable straps.

33. The apparatus of claim 32, wherein said tightenable straps include a hook-and-loop type fastener mechanism to secure and maintain the strap in position when tightened.

34. The apparatus of claim 30, wherein said stop means is in the form of an internal annular shoulder provided in said second ring against which a surface of said first ring abuts when said rings are engaged.

35. The apparatus of claim 34, wherein said shoulder is rounded and the surface of said first ring which abuts said shoulder has a correspondingly rounded leading end.

36. The apparatus of claim 34, wherein said shoulder is tapered and the surface of said first ring which abuts said shoulder has a correspondingly tapered leading end.

37. The apparatus of claim 34, wherein said sealing and retention means is a compressible o-ring.

38. The apparatus of claim 37, wherein said external circumferential surface is formed on a radially extending flange provided on said first ring.

39. The apparatus of claim 38, wherein said o-ring is positioned so as to protrude radially from said radially extending flange.

40. The apparatus of claim 38, wherein an annular face of said radially extending flange abuts said annular shoulder when said rings are engaged.

41. The apparatus of claim 40, wherein the longitudinal extent to which the o-ring is engageable with the internal circumferential surface is only sufficiently long to support the entire compressed width of said o-ring when compressed against the internal circumferential surface of the first ring so as to reduce the duration a disengaging force would have to be applied before disengagement of said rings would occur.

42. The apparatus of claim 30, wherein said first ring includes another radially extending flange, said radially extending flange and said another radially extending flange forming said external circumferential channel of said first ring.

43. The apparatus of claim 30, wherein said second ring is provided with a pair of radially extending flanges which form the external circumferential channel of said second ring.

44. The apparatus of claim 30, wherein said external circumferential channels of said first and second rings are exposed when said rings are engaged.

* * * * *